US005505257A

United States Patent [19]

Goetz, Jr.

[11] Patent Number: 5,505,257

[45] Date of Patent: Apr. 9, 1996

[54] FIN STRIP AND HEAT EXCHANGER CONSTRUCTION

[76] Inventor: Edward E. Goetz, Jr., 27935 Quail Hollow Ct., Farmington Hills, Mich. 48331

[21] Appl. No.: 79,136

[22] Filed: Jun. 18, 1993

[51] Int. Cl.[6] ..... F28F 1/20

[52] U.S. Cl. ..... 165/183; 165/152

[58] Field of Search ..... 165/184, 152, 165/183

[56] References Cited

U.S. PATENT DOCUMENTS

| | | | |
|---|---|---|---|
| 2,063,757 | 12/1936 | Saunders | 165/152 |
| 4,693,307 | 9/1987 | Scarselletta | 165/152 |

FOREIGN PATENT DOCUMENTS

| | | | |
|---|---|---|---|
| 297143 | 3/1954 | Switzerland | 165/184 |

*Primary Examiner*—Allen J. Flanigan
*Attorney, Agent, or Firm*—C. J. Fildes & Co.

[57] ABSTRACT

A corrugated fin strip for heat exchanger tubes has interfacing parallelogram shaped fin panels joined by successive parallel crests, all fin panels having the same parallelogram shape selected in accordance with a desired configuration of the heat exchanger. In one embodiment, these parallel crests extend obliquely between the longitudinal edges of a rectilinear metal strip from which the fin strip is formed, and are adapted to be alternatively attached to the flat face of a heat exchanger tube in oblique relation to parallel sides of the tube, thereby defining an air flow direction oblique to the length thereof. In a second embodiment, the successive parallel crests extend perpendicularly to the opposite edges of the rectilinear metal strip, are displaced alternately therefrom by a selected distance, and are adapted to be attached alternately to the opposed flat faces of a pair of longitudinally parallel heat exchanger tubes, thereby displacing one tube transversely from the other. The fin strip of either embodiment is adapted to be wound in a helix around a cylindrical heat exchanger tube with alternate parallel crests attached to the tube in axial alignment therewith and with each other.

2 Claims, 6 Drawing Sheets

29
30
31
32
33
35
36
37

41
43
44
45
46
47
50

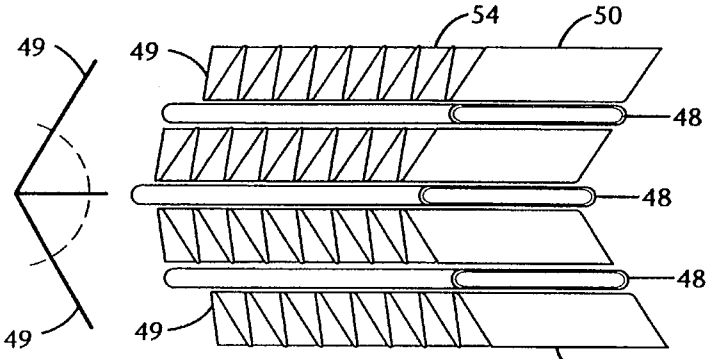
FIG 16
FIG 16 a
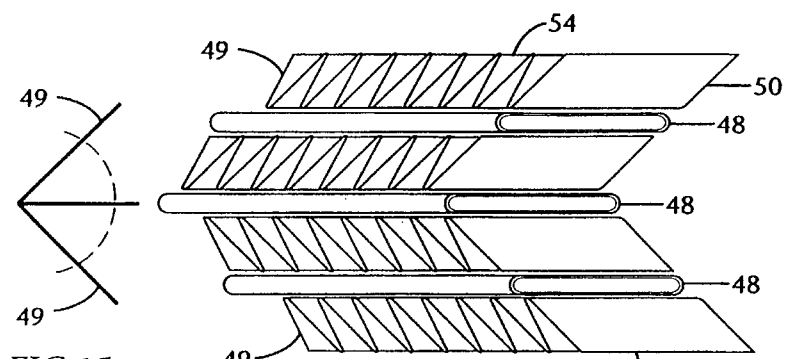
FIG 15
FIG 15 a
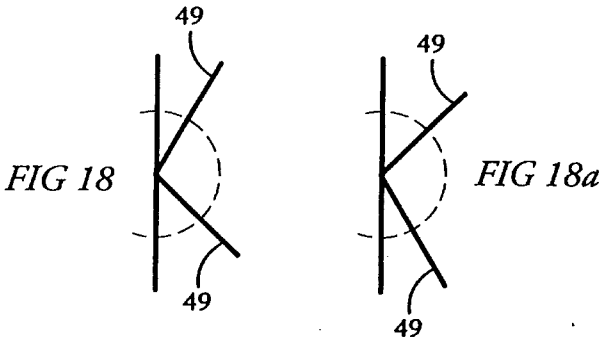
FIG 18a
FIG 18
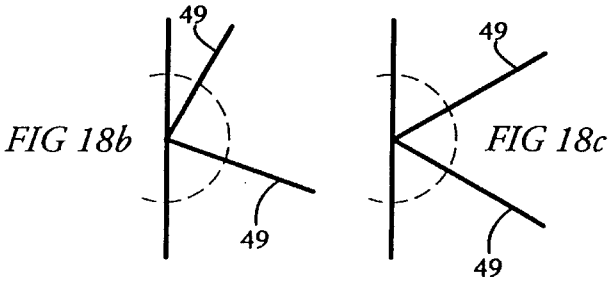
FIG 18c
FIG 18b
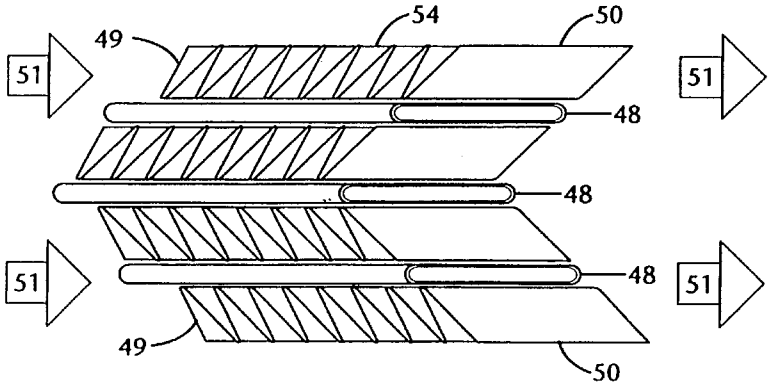
FIG 17

61
63

70
57
58
SECTION A-A
A

FIN STRIP AND HEAT EXCHANGER CONSTRUCTION

SUMMARY OF INVENTION

This invention relates to thermally conductive fins or air centers for heat exchangers and more particularly to new and improved fin strips employing parallelogram shaped corrugations angled to coincide with a desired air flow direction through a heat exchanger having a fluid conducting tube or tubes provided with the fin strips, thereby increasing the thermal conductivity and the operative strength characteristics of the heat exchanger.

Conventional fins or air centers traditionally found in heat exchangers employed in vehicular transportation applications have gone through an extensive evolutionary process to refine their shape, size and weight to produce increased thermal efficiency and strength. Great efforts have been made to simplify the manufacturing process used in producing these fins or air centers to reduce cost and increase production.

Vehicular radiators, such as used in automobiles and trucks, are currently being produced with the most efficient fins or air centers that are commonly available. These air centers or fins are formed out of rectilinear strips of thin wall thermal conductive metal into elongated, corrugated fins having rectangular shaped corrugations of substantially constant height and width formed at right angles to the overall rectangular shape of the fin strip. These fin strips or air centers are placed between the interfacing sides of a plurality of flat, elongated, rectangular fluid conductive tubes to form the overall active radiator core surface.

The radiators or heat exchangers that utilize the aforementioned fin design are generally constructed with the tubes in a vertical or sometimes a horizontal position, and are placed in the vehicle in an upright or vertical position regardless of the tube coolant flow direction. The vehicle typically has a vertically mounted horizontal axial fan or fans to help draw air through the active core sections of the heat exchanger. The most common feature that is inherent in the current heat exchanger and fin designs provides for air flow that is perpendicular to the active core surface plane. This restrictive feature generally dictates that the heat exchanger is mounted in the vehicle along with the axial fan or fans in a vertical position to better utilize the horizontal air flow generated by the forward motion of the vehicle.

Air conditioned vehicles require an additional heat exchanger to condense the refrigerant utilized in the air conditioning system. In most applications the air conditioning condenser is mounted in close proximity to the radiator on the same vertical plane. Thus in most design exercises the condenser, radiator and fan or fans are installed in the vehicle as a package in a vertical manner.

Mounting the air conditioning condenser, radiator and fan in a vertical position restricts the shape of the body line of the automobile or truck by the overall collective height of these parts, thereby increasing the C.D. value (coefficient of air resistance) and adversely effecting vehicle performance, fuel economy, and styling efforts to improve line profile of the vehicle.

A corrugated fin strip of the invention is adapted to be applied to an outer surface of a fluid conducting tube of a heat exchanger and comprises a metal strip of thermally conductive material having transversely spaced longitudinally extending opposite edges. Provided in this metal strip is a series of corrugated fins formed by interfacing parallelogram shaped fin panels joined by successive parallel crests each extending from at least one of the opposite edges of the metal strip. These parallelogram shaped fin panels are substantially equal in their longitudinal and transverse dimensions and are defined by substantially equal acute and obtuse angles which are selected in accordance with a desired overall configuration of the heat exchanger tubes.

In a first embodiment of the invention, the successive parallel crests of the parallelogram shaped fin panels extend obliquely from one edge of the metal strip to the other. Alternate crests of this corrugated fin strip can be attached to a flat face of a fluid conducting tube of a heat exchanger so as to extend obliquely to parallel linear sides of the tube. Such a heat exchanger tube (or tubes) can be positioned at an angle to the direction of air flow corresponding to the obliquity of the fin panel crests, since the optimum air flow direction is parallel thereto and to the faces of the fin panels joined thereby. This corrugated fin strip is preferably made with a width substantially equal to the width of the tube to which it is attached so that the alternate parallel crests extend in contact with the flat face of the tube a distance greater than the transverse dimension of the tube, thereby increasing the heat dissipating capability of the fin strip and the pressure ballooning burst strength of the tube.

In a second embodiment of the invention, the successive parallel crests of the corrugated fin strip extend perpendicular to the opposite edges of the metal strip with successive crests being displaced alternately and substantially equally from those edges by a selected distance. This form of corrugated fin strip is adapted to be used between opposed flat faces of a pair of parallel longitudinal heat exchanger tubes with the successive parallel crests of the fin strip attached alternately to the opposed flat faces. The parallel linear sides of one of the pair of tubes are thereby displaced transversely relative to the sides of the other tube of the pair to an extent which is substantially defined by the distance selected for the alternate displacement of successive parallel crests from the opposite edges of the metal strip. Parallel heat exchanger tubes connected with this form of corrugated fin strip can be staggered or inclined either in a common plane, or in multiple planes arranged at a desired angle to each other.

A corrugated fin strip of either of these first and second embodiments can be used with a heat exchanger tube having a cylindrical outer surface, the fin strip being wound in a helix around the cylindrical outer surface with alternate parallel crests attached thereto and extending axially thereof, preferably in axial alignment. The corrugated fin strip of the first embodiment is preferred for this use, since the angle of the helix corresponds to the obliquity of the successive parallel crests.

Other features and advantages of the invention will appear from the description to follow of the embodiments disclosed in the accompanying drawings.

DESCRIPTION OF THE DRAWINGS

FIG. 15 is a perspective view of a portion of a heat exchanger core section incorporating fin strips of FIG. 12;

FIG. 15*a* is a diagram illustrating the angular relation between successive portions of core section of FIG. 15;

FIG. 16 is a perspective view similar to FIG. 15 of a heat exchanger core section having a different angular relation, illustrated in FIG. 16*a*, between successive portions thereof;

FIG. 17 is a perspective view showing air flow direction through the core section of FIG. 15;

FIGS. 18 through 18*c* are diagrams illustrating variations in the angular relation of core section portions obtainable in the practice of the second embodiment of the invention;

DETAILED DESCRIPTION

Figures 1, 1A, 1B, 1C, 2, 2A, 2B, 2C, 2D, 2E, 3, 3A, 4:
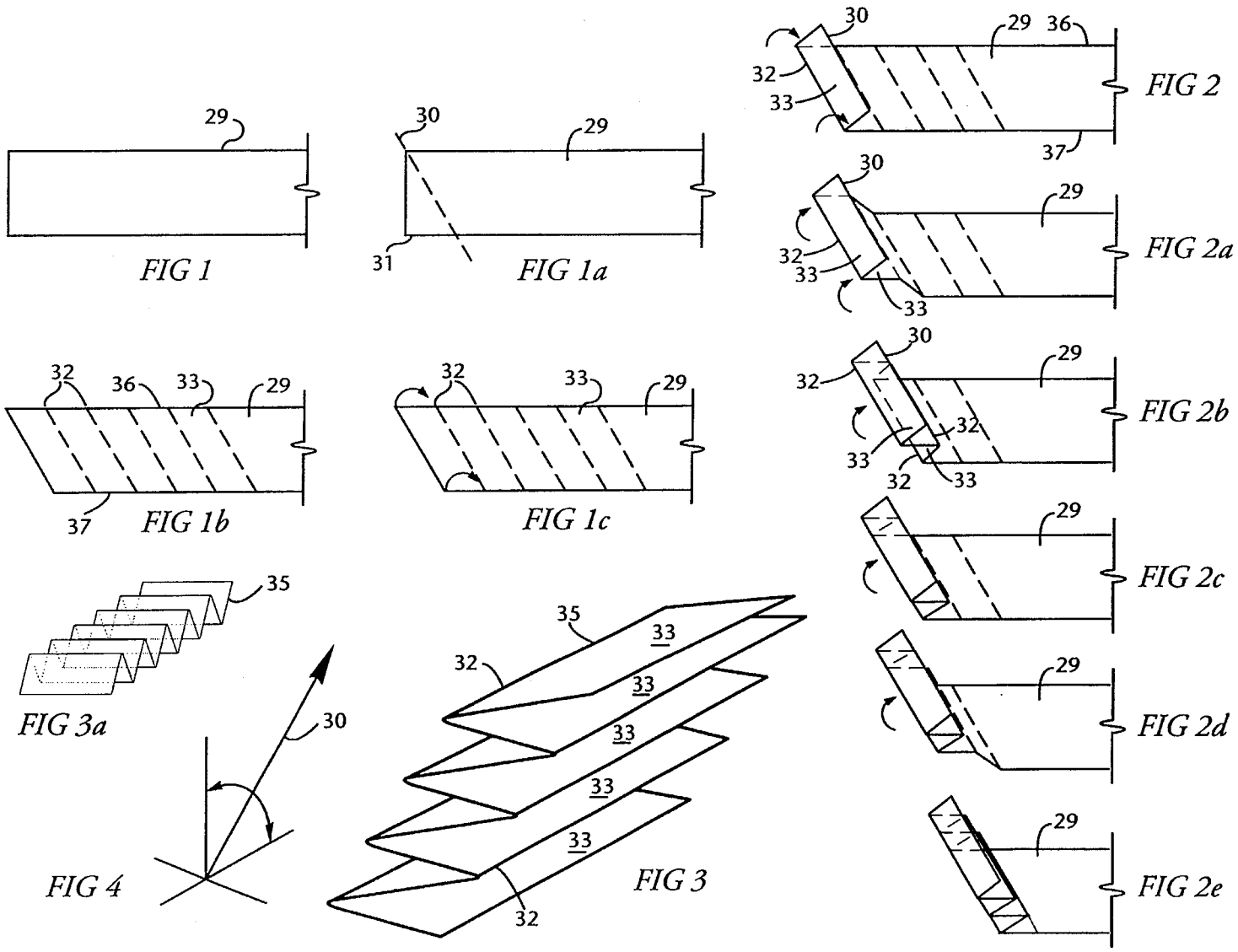
FIG. 1 is a plan view of a strip of fin forming material.
FIGS. 1*a*, 1*b* and 1*c* illustrate successive steps for the layout of fins to be formed in the strip of FIG. 1 in a first embodiment of the invention.
FIGS. 2 through 2*e* illustrate successive steps in the formation of fins in the strip of FIG. 1.
FIG. 3 is an enlarged perspective view of a fin strip formed by the steps of FIGS. 2–2*e;*
FIG. 3*a* is another perspective view of the fin strip of FIG. 3.
FIG. 4 is a diagram illustrating the angularity ranges of fin strips formable in the first embodiment of the invention.

Turning now in greater detail to the drawings, there is shown in FIG. 1 a portion of flat thin wall thermally conductive metal strip 29 of material commonly used in forming elongated corrugated fins for heat transfer devices, such as radiators for automotive or truck applications.

FIG. 1*a* shows the metal strip 29 of FIG. 1 with a predetermined oblique angled cutting line 30 marked across its surface to define an acute angled end piece 31. This oblique angled line 30 serves as a critical root or base dimension line that determines the overall angle of inclination of the entire finished structure.

FIG. 1*b* shows the metal strip of FIG 1*a* with the acute angled end piece 31 removed and oblique angled parallel reference lines 32 marked across the surface from one linear edge to 36 the other linear edge 37. The reference lines 32 are the forming lines for the successive parallel radiused crests of the corrugations. The reference lines 32 also divide the strip into substantially equal parallelogram shaped panels 33 defined by substantially equal acute and obtuse angles.

FIG. 1*c* shows the metal strip 29 of FIG. 1B with arrows indicating the direction and method of folding the strip to form the first corrugation.

FIGS. 2 through 2*e* are a sequential series of diagrams illustrating the metal strip 29 of FIG. 1*c* folded into an inclined angled strip 35 of corrugated fin as illustrated in FIG. 3 and FIG. 3*a*, formed by the interfacing panels 33 joined by the successive parallel crests 32 extending between the edges 36 and 37. This embodiment of the invention offers a selectable angle of inclination that can be built into the fin strip 35, since the angle of line 30 determines the angle of the fin strip as it is progressively formed as is shown in FIGS. 2 through 2*e*. The angle of inclination in this embodiment of the invention can also be changed by compressing or expanding the fin strip 35 after it has been formed. The variable angles of inclination that can be formed or shaped into the fin strip are depicted in the pictorial diagram of FIG. 4.

Figure 5B:
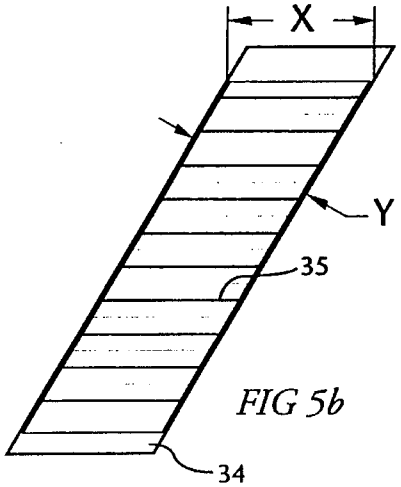
FIGS. 5*a* and 5*b* are end and side elevations, respectively of FIG. 5.
Figure 5:
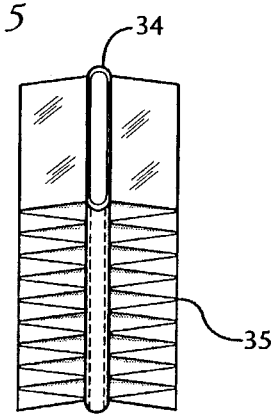
FIG. 5 is a plan view of an inclined tube having fin strips of FIG. 3 applied to the sidewalls thereof.

Constructional examples of the first embodiment of the invention are presented in FIGS. 5 through 8. FIG. 5 is a top view of an inclined flat fluid conducting tube 34 of a heat exchanger engaged with two rows of the parallelogram shaped fin strips 35 of FIGS. 3 and 3*a*. The tube 34 has opposite flat faces joined by parallel linear sides, and alternative ones of the parallel crests of each fin strip 35 are attached to one of the flat faces and extend obliquely to the parallel linear sides.

Figure 5A:
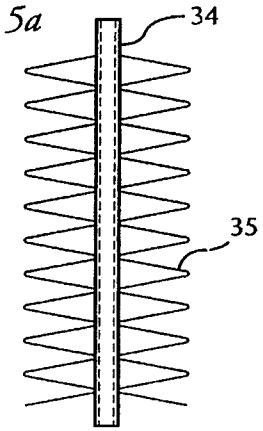

FIG. 5*a* is an end view of the tube 34 and fin strips 35 of FIG. 5.

FIG. 5*b* is a side elevational view of the tube 34 and fin strips 35, and illustrates that since the optimum direction of air flow is parallel to the fin panels 33, the angle of the tube 34 to the vertical, and hence the configuration of a heat exchanger core section formed by a plurality of such tubes, is controlled by the acute and obtuse angles of each parallelogram shaped panel 33 of the fin strip 35, which angles in turn result from the angle selected for the base line 30 in FIG. 1*a*. It should also be noted in FIG. 5*b* and in the perspective view, FIG. 6, that the width X of the fin strip 35 is substantially larger than the width Y of the tube 34. This distinctive feature occurs by virtue of the oblique placement of the crests 32 of the fin strip corrugations against the tube sides, which permits a substantially larger area of the tube side wall to be engaged operatively with the fin strip corrugations, and which allows the fin strips 35 to dissipate more heat energy from the tube than conventional fins that are connected to the tube perpendicular to the linear edges of the tube.

The oblique placement of the fin strips 35 also provides the tube with a definitive increase of pressure ballooning burst strength not obtainable with conventional fins.

Figure 8:
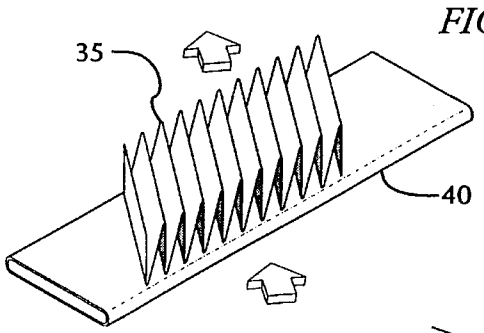
FIGS. 7 and 8 are perspective views illustrating air flow directions for the tube and fin strip of FIG. 5, with the tube in FIG. 8 shown in a position perpendicular to the tube in FIG. 7.
Figure 6:
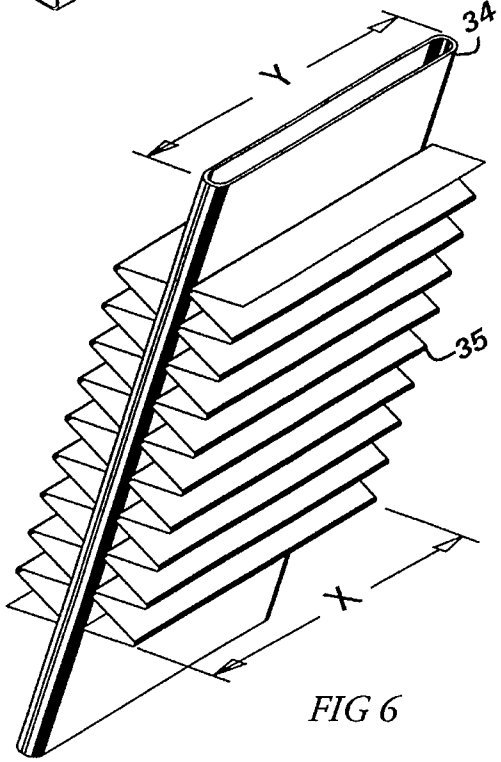
FIG. 6 is a perspective view of the tube and fin strip assembly of FIG. 5.
Figure 7:
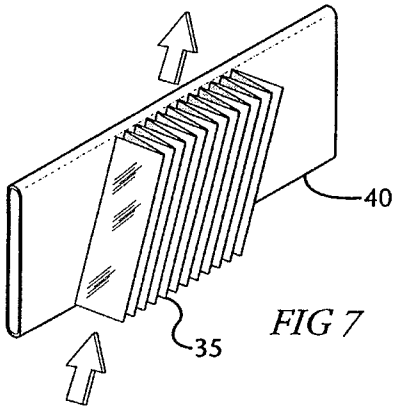

FIG. 7 and FIG. 8 depict directional arrows indicating the parallel flow of cooling air through the fin strip 35 of FIG. 3 and a singular tube 40 similar to the tube 34 of FIG. 5. The air flow direction is variable by virtue of the placement of the fin strip 35 against the tube 40 in an oblique manner. This specific feature applies to both FIG. 7 where the tube 40 is in a vertical position and to FIG. 8 where the tube 40 is in a horizontal position. The available design flexibility in the configuration of heat exchangers is apparent from FIGS. 5–8, the fluid conducting tubes being arrangeable vertically, horizontally and angularly, as desired.

Figures 9, 9A, 9B, 9C, 9D, 10, 10A, 10B, 10C, 10D, 10E, 11, 12, 13, 14:
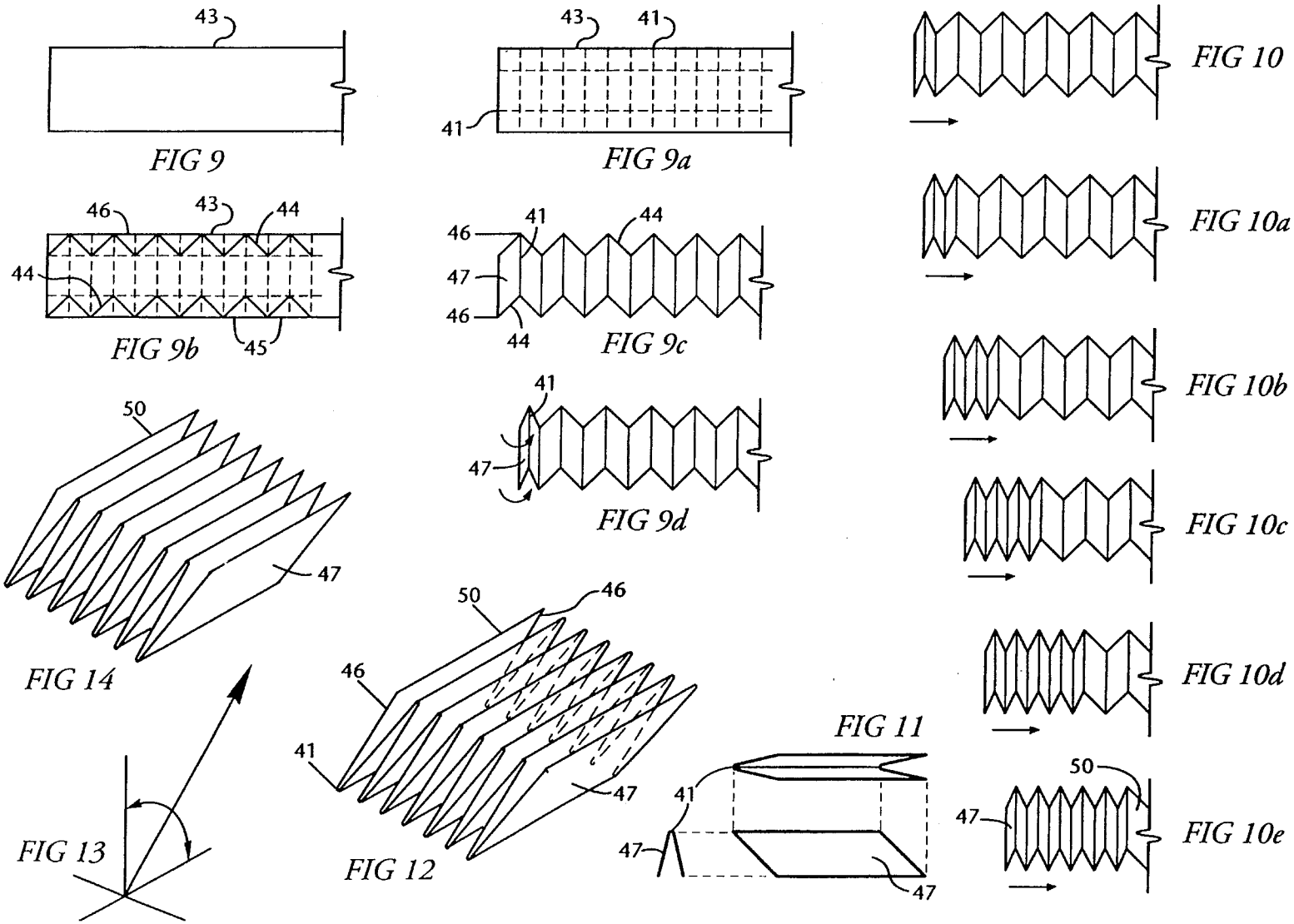
FIG. 9 is a plan view of a piece of fin strip material.
FIGS. 9*a*, 9*b*, 9*c* and 9*d* illustrate successive steps in the layout and initial forming of fins in the fin strip of FIG. 9 in a second embodiment of the invention.
FIGS. 10 through 10*e* show successive steps in the formation of fins in the fin strip of FIG. 9*d;*
FIG. 11 is a three-way top, side and end view of one fin formed in the steps of FIGS. 10–10*e;*
FIGS. 12 and 14 are perspective views of the fin strip of FIG. 10*e;*
FIG. 13 is a diagram illustrating the angularity range of fin strips formable in the second embodiment of the invention.

Moving on to the second embodiment of the invention, FIG. 9 shows a rectilinear, flat thin wall strip 43 of thermally conductive metal similar to the metal strip 29 of FIG. 1.

FIG. 9*a* shows the metal strip 43 of FIG. 9 with equalized perpendicular transverse and longitudinal reference lines 41 and 41' applied across its surface. The dimensions and placement of these lines 41 and 41' determine the size of the corrugations and the angle of inclination of the entire fin structure.

FIG. 9*b* depicts the metal strip 43 of FIG. 9 and the reference lines 41 and 41' of FIG. 9*a* with cutting lines 44 applied across the surface of the strip along each linear edge 46. These cutting lines extend between the edges 46 and the alternative intersections of the longitudinal reference lines 41' and the transverse reference lines 41; and, together with the transverse reference lines 41, divide the strip 43 into a series of alternating parallelograms 47 which will form the side panels of corrugations having radiused ends defined by the transverse reference lines 41. The angled pieces 45 are then removed as shown in FIG. 9*c* so that each linear edge 46 of the metal strip is notched along the strip's entire length, as shown in FIG. 9*c*.

FIG. 9*d* shows the metal strip of FIG. 9*c* with directional arrows indicating the direction and method of folding the strip to form the first fin corrugation.

FIG. 10 through 10*e* are a sequential series of diagrams illustrating the metal strip of FIG. 9*d* formed into a corrugated fin strip 50 with successive parallel crests 41 joining parallelogram shaped side panels 47 substantially equal in longitudinal and transverse dimensions and being defined by substantially equal acute and obtuse angles. Successive crests 41 are alternately substantially equally displaced from the opposite edges 46 of the metal strip 43 by the distance selected for the placement of the reference lines 41'. FIG. 11 shows a 3-view diagram of one complete corrugation with two of the parallelogram shaped side panels 47 depicted in the side view.

FIG. 12 and FIG. 14 are perspective views of the fin strip 50 of FIG. 10*e* showing that the overall shape of the resulting fin strip 50 is that of a parallelogram. FIG. 13 is a pictorial diagram showing the variable angle of inclination that can be selectively employed in this embodiment of the invention.

The fin strips 50 illustrated in FIGS. 12 and 14, are employed as air centers in a heat exchanger core structure 54 of FIG. 15. This core structure is shown having parallel horizontal tubes 48 arranged to form convergent core sections 49 that are connected to one another. The angle of inclination of the two sections 49 is depicted by the diagram FIG. 15*a*. Each of the tubes 48 has flat faces and parallel linear sides. The successive parallel crests 41 of a fin strip 50 positioned between an adjacent pair of the tubes 48 are attached alternately to the opposed flat faces thereof. As a result, the sides of one of the pair of adjacent tubes are displaced transversely related to the sides of the other tube of the pair. This transverse displacement, or inclination, of adjacent tubes is substantially defined by the distance selected for the placement of the reference lines 41'.

FIG. 16 shows a core structure 54' similar to the structure 54 in FIG. 15. This core structure 54' has convergent core sections 49 also, but at a lesser degree of inclination, as shown in the diagram FIG. 16*a*.

FIG. 17 depicts the core structure 54 of FIG. 15 with directional arrows 51 indicating the horizontal flow of cooling air through the core sections. This important feature allows the core sections to be arranged in various angles of inclination as illustrated in FIG. 18 through 18*c* and the air flowing through the core section or sections remains in a horizontal path in its direction through the fin strips 50.

The fin strips 50 of the second embodiment of the invention enable the construction of horizontal air flow heat exchangers having successive core sections staggered or inclined either in a common plane, or in multiple planes arranged at a desired angle to each other. A heat exchanger can thus be provided with a configuration most suitable for space constraints of a particular installation.

Figure 20:
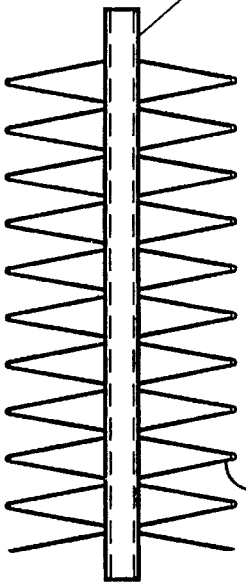
Figure 19:
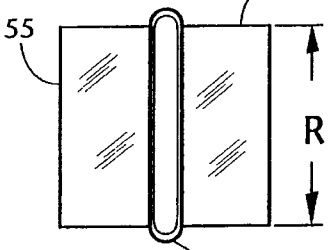
FIG. 19 is a top plan view of a conventional tube and fin strip assembly.

FIG. 19 is a top view of a single flat vertical tube 52 with two rows of commercially available conventional corrugated fin strips 55 securely fastened to the side walls of the tube. FIG. 20 is an end view of the tube and fin strips of FIG. 19.

Figure 21:
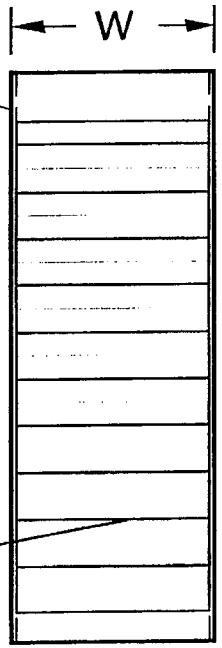
FIGS. 20 and 21 are end and side elevations, respectively of the assembly of FIG. 19.

FIG. 21 is a side elevational view of FIG. 20.

Figure 22:
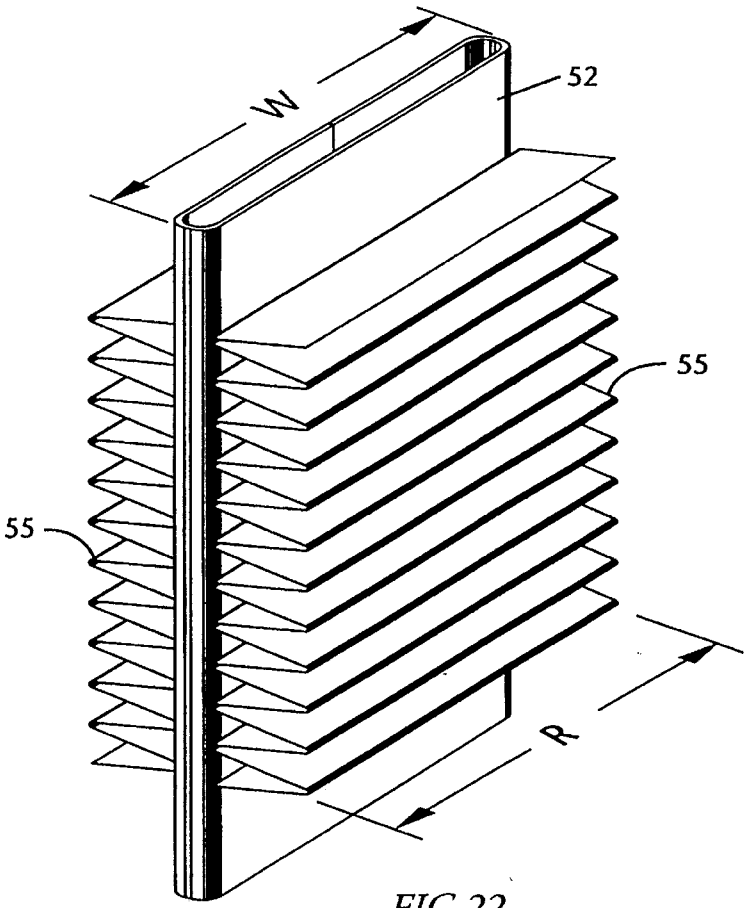
FIG. 22 is a perspective view of the assembly of FIGS. 19–21.

FIG. 22 is a perspective view of the tube and fin strips of FIGS. 19, 20 and 21 dimensioned with the capital letter "W" indicating the width of the tube 52 and the capital letter "R" indicating the width of the fin strip 55. These two dimensions are substantially equal in most applications. The tube fin structure shown in FIG. 22 illustrates a section of the state of the art heat exchanger core construction currently being utilized in automotive radiator and applications.

In an automotive radiator application the core sections are usually arranged with the tubes in a vertical or horizontal position to best utilize the flow of cooling air that is entering the engine compartment in a substantially horizontal direction when a vehicle is in motion. In some automobile applications the radiator has been installed in a slightly inclined position but the degree of inclination is limited by the required flow of air through the radiators core sections parallel to the corrugations of the fin strips.

Looking now at the tube and fin structure of FIG. 22 the corrugations of the fin strip 55 are perpendicular to the sides of the tube 52 and afford the tube a specific amount of surface support which resists the tendency of the tube to swell and burst from pressure ballooning. The perpendicular arrangement of the tube 52 to the fin strip 55 also governs the specific rate of heat rejection capacity inherent in the structure.

In comparing the heat exchanger core structures described in the first and second embodiments of this invention to the conventional structure shown in FIGS. 19 through 22, the distinctive advantages of this invention should become apparent to anyone skilled in the art.

Figures 23, 23A, 23B, 23C, 24, 24A, 24B, 24C:
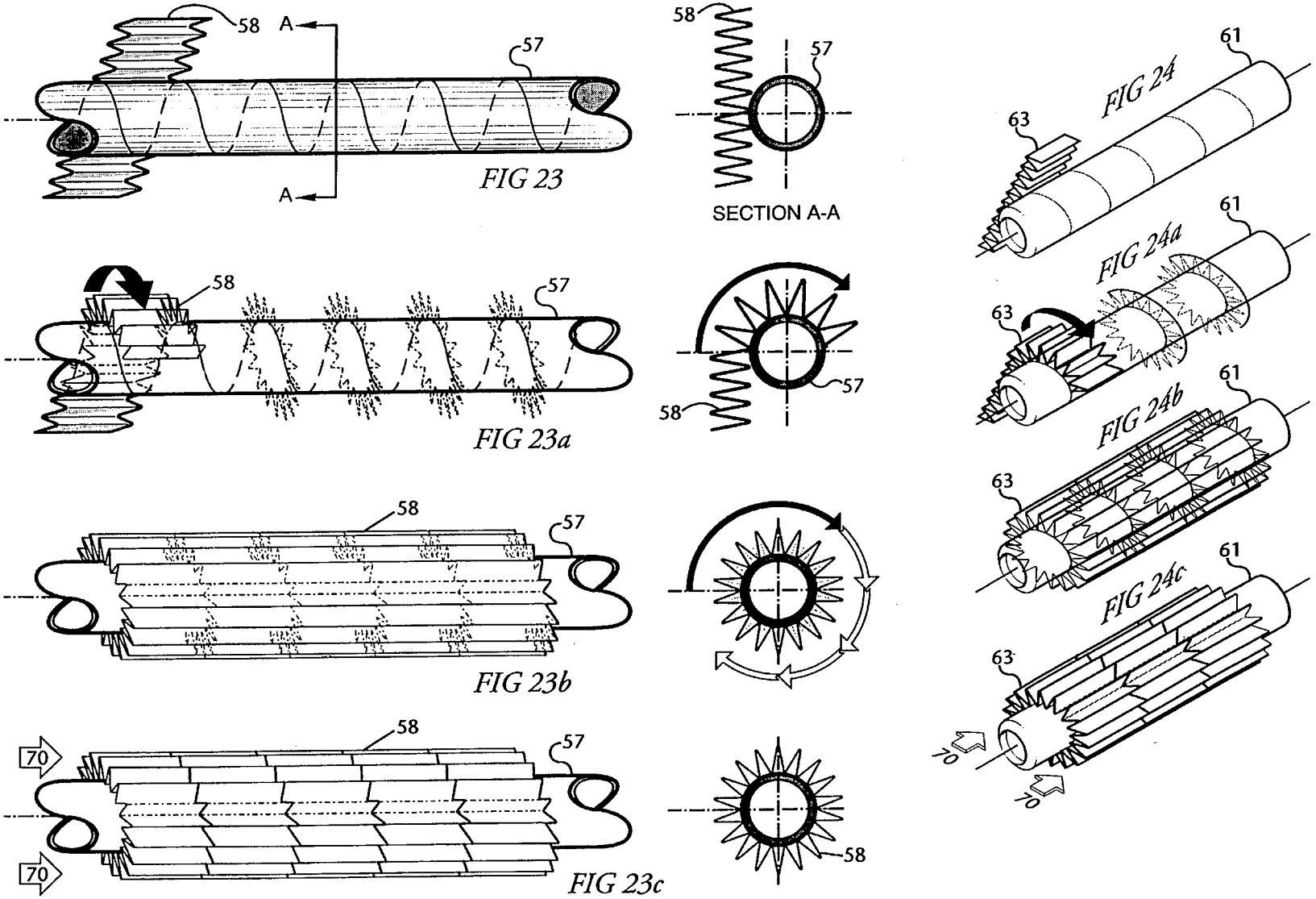
FIG. 23 is a side and end elevation of a cylindrical tube and a fin strip of the type shown in FIG. 10*e;*
FIGS. 23*a* through 23*c* sequentially illustrate the tube and fin strip of FIG. 23 with the fin strip wrapped helically around the outer surface of the tube.
FIG. 24 is a perspective view of a cylindrical tube and a fin strip of the type shown in FIG. 3.
FIGS. 24*a* and 24*b* illustrate the fin strip of FIG. 24 being wrapped helically around the outer surface of the tube of FIG. 24.
FIG. 24*c* is a perspective view of the tube and fin assembly resulting from the steps of FIGS. 24*a* and 24*b*.

A third embodiment of this invention is shown in FIGS. 23 through 23*c*. FIG. 23 depicts a longitudinal cylindrical fluid or gas conductive tube 57 including a section of parallelogram fin strip 58 of the type shown before in FIG. 12 and FIG. 14, and also includes a cross sectional end view depicting the fin strip 58 and tube 57. FIG. 23*a* and FIG. 23*b* illustrate the fin strip 58 and tube 57 of FIG. 23 wherein the fin strip is attached to the tube at a slight degree of inclination and is subsequently coiled or gathered onto the tube in a helical manner. The end views indicate the attachment points of alternate ones of the parallel crests the fin corrugations to the cylindrical outer surface of the tube. FIG. 23*c* exhibits the resulting tube and fin strip structure subsequent to the steps shown in FIGS. 23 through 23*b* and also depicts the uniform dispersion of the fin strip 58 around the circumference of the tube 57 and the symmetrical intervoled junction of the fin strip 58 to the tube 57 with the parallel crests extending and aligned axially. The arrows 70 indicate air flow direction.

A fourth embodiment of the invention is illustrated in FIGS. 24 through 24*c*, the fundamental difference being the choice of fin strip. FIG. 24 shows a tube 61 similar to the tube 57 of FIG. 23; however, the fin strip 63 is the parallelogram type of fin strip 35 of FIG. 3 and FIG. 3*a*.

The fin strip 63 shown in FIG. 24 has a built-in degree of inclination that allows the fin strip to be intervoled and joined to the tube in a continuous and harmonious manner as exhibited in FIG. 24*a* and FIG. 24*b*, since that angle of inclination or obliquity corresponds to the angle of the helix winding. The resulting fin strip and tube structure is shown in FIG. 24*c* with the arrows 70 indicating air flow direction.

The fourth embodiment illustrates the most logical and efficient means by which to produce a structure of this type. In FIG. 24*c* the corrugations of the fin strip 63 are uniform throughout the finned section of the structure and therefore provide the tube 61 with the capacity to dissipate thermal energy at a constant proportionate rate around the total circumference of the tube 61. Although not shown in the drawings, the density of the fin strip corrugations operatively connected to the tube can be substantially increased by virtue of the variform design flexibility incorporated in the parallelogram fin strip of the first embodiment.

While the above description constitutes presently preferred embodiments of the invention, it will appreciated that the invention can be modified and varied without departing from the scope of the accompanying claims.

I claim:

1. In combination, a corrugated fin strip applied to an outer surface of a fluid conducting tube of a heat exchanger, said fluid conducting tube having opposite flat faces joined by parallel linear sides, said corrugated fin strip comprising:

a metal strip of themally conductive material having transversely spaced longitudinally extending opposite edges;

a series of corrugated fins provided in said metal strip, said corrugated fins being formed by interfacing parallelogram shaped fin panels joined by successive parallel crests each extending obliquely from one to the other of said opposite edges, said parallelogram shaped fin panels being substantially equal in longitudinal and transverse dimensions and being defined by substantially equal acute and obtuse angles selected in accordance with a desired configuration of said heat exchanger;

alternate ones of said parallel crests of said corrugated fin strip being attached to one of said flat faces of said fluid conducting tube and extending obliquely to said parallel linear sides.

2. A combination according to claim 1 wherein said alternate ones of said parallel crests attached to said one of said flat faces extend in contact therewith a distance greater than the transverse dimension of said tube between said linear sides thereof.

* * * * *